US005193471A

United States Patent [19]

Badillo et al.

[11] Patent Number: 5,193,471

[45] Date of Patent: Mar. 16, 1993

[54] MATERIAL REMOVAL DEVICE USED WITH A SEWING MACHINE

[75] Inventors: Ralph Badillo; Paul Badillo, both of Littleton, Colo.

[73] Assignee: Ralph's Industrial Sewing Machine Company, Denver, Colo.

[21] Appl. No.: 764,332

[22] Filed: Sep. 23, 1991

Related U.S. Application Data

[63] Continuation-in-part of Ser. No. 633,497, Dec. 26, 1990.

[51] Int. Cl.[5] ..... D05B 3/10; B26D 7/18

[52] U.S. Cl. ..... 112/68; 83/53; 83/100

[58] Field of Search ..... 83/100, 53; 112/68, 112/264.1, DIG. 3, 66, 68, 129, , 122, 130, 121.12, 40, 44, 65, 262.1

[56] References Cited

U.S. PATENT DOCUMENTS

| | | | |
|---|---|---|---|
| 345,663 | 7/1886 | Blodgett . | |
| 1,225,247 | 5/1917 | Hill . | |
| 1,650,588 | 11/1927 | Allen . | |
| 2,182,744 | 12/1939 | Ehrsam | 83/100 X |
| 2,463,455 | 3/1949 | Dann | 83/100 X |
| 2,489,559 | 12/1949 | Boyle | 83/100 |
| 2,515,740 | 7/1950 | Smith et al. . | |
| 2,707,028 | 4/1955 | Burton | 83/100 |
| 2,954,001 | 9/1960 | Luxemburg . | |
| 3,111,921 | 11/1963 | Kleemann et al. . | |
| 3,948,194 | 4/1976 | Gunold . | |
| 4,077,340 | 3/1978 | Braun et al. . | |
| 4,160,396 | 7/1979 | Matzner et al. | 83/100 |
| 4,200,417 | 4/1980 | Hager | 83/100 X |
| 4,308,774 | 1/1982 | Bohler et al. | 83/100 |
| 4,501,207 | 2/1985 | Miyazaki et al. . | |
| 4,589,358 | 5/1986 | Goldbeck et al. . | |
| 5,085,157 | 2/1992 | Jung et al. | 112/68 |

FOREIGN PATENT DOCUMENTS 7634151 4/1977 Fed. Rep. of Germany .

*Primary Examiner*—Andrew M. Falik
*Assistant Examiner*—Paul C. Lewis
*Attorney, Agent, or Firm*—Sheridan, Ross & McIntosh

[57] ABSTRACT

An assembly for use in combination with sewing machines for purposes of removing portions of stitchable material around which a buttonhole or other desirable design is sewn by the sewing machine. In one embodiment, the assembly is a kit which includes a support assembly, a material removal device positioned within the support assembly, and a driver connected to the material removal device to supply the necessary forces to remove portions of material. The kit assembly may be attached to a sewing machine without requiring any substantial modification thereof and, if properly positioned, will not interfere with sewing operations and the components associated therewith. The kit assembly may also be removed or disabled to allow the sewing machine to perform functions other than sewing buttonholes. In another embodiment, a portion disposal system is utilized to carry away and preferably contain the removed portions of material.

3 Claims, 10 Drawing Sheets

MATERIAL REMOVAL DEVICE USED WITH A SEWING MACHINE

RELATED APPLICATIONS

This application is a continuation-in-part application of U.S. patent application Ser. No. 07/633,497, filed Dec. 26, 1990, and entitled "KIT ASSEMBLY ADAPTED FOR USE WITH A PROGRAMMABLE SEWING MACHINE."

FIELD OF THE INVENTION

This invention generally relates to an apparatus which removes material to create a hole around which a pattern or other stitching may be sewn to produce a buttonhole or other desirable design, and in one embodiment to a kit assembly which may be attached to a programmable sewing machine without requiring essentially any structural modification thereof to allow such machines to perform multiple functions.

BACKGROUND OF THE INVENTION

A number of programmable sewing machines have been devised and are currently available on the market today, one of which is the Model AMS-206A by Juki. Sewing machines of this type offer a number of advantages. For instance, sewing operations are controlled by computer software. More particularly, sewing patterns stored in computer memory and accessible by the software are used to control the movement of a presser foot assembly which engages and moves the stitchable material relative to the sewing needle to produce a desired, preselected pattern. Consequently, programmable sewing machines are commonly used in commercial, high production applications.

One of the many uses of programmable sewing machines is for sewing a selected patterned design around an opening in stitchable material to produce a buttonhole or other desirable design. Although no presently known programmable sewing machine incorporates a punch or other assembly for removing stitchable material, there are separate punching machines commercially available. Utilizing a separate punching machine with a programmable sewing machine, however, is disadvantageous in that not only is more space required, but the additional punching machine increases both the initial capital expenditure and subsequent maintenance costs. Furthermore, the capabilities of the programmable sewing machine may not be fully realized in this type of configuration.

Unlike programmable sewing machines, there are non-programmable sewing machines commercially available which integrate a punch assembly with sewing operations. U.S. Pat. Nos. 345,663 to Blodgett issued Jul. 20, 1886; 1,225,247 to Hill, issued May 8, 1917; 1,650,588 to Allen, issued Nov. 29, 1927; and 2,515,740 to Smith, et al., issued Jul. 18, 1950 are representative of this type of machine. Although configurations of this type alleviate the need for a separate punching machine, a number of disadvantages are evident based primarily upon the complex manner in which the drive assemblies for sewing and punching operations are typically coupled and integrated. For instance, maintenance costs for these machines are increased since they are both more difficult to repair and since there are additional parts which are subject to wear and/or breakage. Moreover, the complex integration of both operations effectively limits the use of these machines to one function—that of sewing buttonholes. Relatedly, in order to possibly limit the increase in size necessitated by adding the punching assembly, machines of this type commonly perform punching and sewing operations in the same general area, that being the cylinder bed.

Although welting machines cannot be used for buttonhole sewing operations, such machines do typically perform a material cutting operation outside the cylinder bed. Welting machines are used to form welts for pockets on coats and other articles of clothing. A typical welting machine initially places two end cuts on the material to define the ends of the pocket by utilizing the upward movement of knives positioned outside the cylinder bed. The machine then transfers the material to the cylinder bed to align one of the end cuts with a downwardly reciprocating knife and a sewing needle which are positioned in close proximity to each other. As the material is advanced, the reciprocating knife cuts the material toward the second end cut while the trailing needle sews the welt. Welting machines, however, are generally limited to a single function due to the manner in which the cutting and sewing operations are integrated. Moreover, although there is a material cutting operation performed outside the cylinder bed, no amount of material is removed since the upwardly reciprocating knife merely separates the fibers forming the material.

One apparatus which addresses the need for a detachable punch-type assembly is U.S. Pat. No. 2,954,001 to Luxenburg, issued Sep. 27, 1960, which generally discloses an automatic eyelet attachment. The eyelet attachment, which includes a punch and presser foot, is positioned on a standard non-programmable sewing machine in place of the original presser foot. When sewing an eyelet, the punch penetrates and spreads fibers but does not actually remove any substantial amount of material. With the punch remaining in the material, the needle stitches a pattern therearound to form the eyelet. A disadvantage of a punch of this type is that the material tends to pucker when the punch is inserted, resulting in a product which may be aesthetically displeasing. Consequently, this puts a realistic limitation on the size of the eyelet that can be produced since larger punches of this type will only increase puckering. Moreover, the punching operation takes place in the sewing area or cylinder bed since the needle actually sews around the punch while in the material to form the eyelet. Furthermore, positioning this eyelet attachment on a programmable sewing machine which automatically advances the stitchable material by movement of the presser foot assembly would not appear to provide an operational system. More particularly, the presser foot assembly of a programmable sewing machine moves during sewing operations which would introduce a problem since the punch disclosed by Luxenburg, which is attached to the presser foot, remains in the material while the eyelet is sewn.

In some applications, it may be desirable to not only remove material portions of stitchable materials with a punching-type assembly, but to dispose of such removed portions as well. For instance, fibers or strands of material may be generated during the removal operations and such materials may collect and adversely affect the performance of the sewing machine. Moreover, in high production applications the removed portions, if not properly disposed of, may also present a number of problems.

A single action pneumatic cylinder punch is available from BIMBA which utilizes one type of a disposal system. The BIMBA cylinder is used to punch relatively heavy materials such as plastics. In this regard, the cutting head is hollow and is connected to a hollow shaft of the cylinder. The cylinder shaft is attached to the piston which has a small orifice therein which is aligned with the hollow portion of the cylinder shaft. Consequently, when air is applied to drive the piston, cylinder shaft, and cutting head in a downward direction, a comparatively small air flow simultaneously passe through the orifice in the piston and through the hollow portion of the shaft and cutting head such that the removed portion, when formed, will be displaced from the hollow cutting head. Therefore, air is actually applied to the portion to be punched prior to the removal of such portion and actually even prior to the cutting head contacting such portion.

SUMMARY OF THE INVENTION

One embodiment of the present invention is a kit assembly for removing stitchable material which may be detachably connected to various types of sewing machines, but is particularly suited for use with those which are programmable. Generally, the kit assembly removes portions of stitchable material to produce an opening or hole around which a buttonhole or other desirable design may be sewn. When used with a programmable sewing machine, preferably the material removal operations, like sewing operations, are controlled by software to provide a fully automated system.

In a preferred embodiment of the kit assembly, the present invention includes three primary components, namely a support assembly, a material removal device and a driver. The support assembly is detachably connected to the programmable sewing machine and is configured so as to not interfere with the machine's sewing operations, including its drive assembly. In one embodiment the support assembly includes a housing, mounted on the end of the head of the machine and which contains the material removal device, and a table with a recessed receiver, mounted substantially adjacent to and parallel with the cylinder bed an which supports the stitchable material and receives the material removal device after it has completely extended through the material.

The material removal device, most commonly a punch or any other suitable device such as a cutting tool, which removes the desired portions of stitchable material has a shaft that, in one embodiment, is positioned within a sleeve-lined bore in the housing to limit deflection of the material removal device when used on thicker, more resilient stitchable materials, and a cutting head configured to produce the desired contour of the opening which, in one embodiment, is removable from the shaft to allow for easy change of the contour of the opening, i.e., change the shape of the opening from a buttonhole to a different shaped opening. Attached to the material removal device is the driver which provides the necessary driving forces for material removal operations. Although the driver may be positioned within the housing, in one embodiment, the driver is an air cylinder positioned above the head of the programmable sewing machine so that the sewing drive assembly does not limit the size of the air cylinder.

The driver may be manually actuated, although in one embodiment it is controlled by software when used with a programmable sewing machine so as to provide fully automated buttonhole sewing operations. In this embodiment, the driver is automatically activated to propel the cutting head of the material removal device down through the stitchable material and into the recessed receiver in the table to remove the desired portion of stitchable material.

When the embodiment utilizing the housing, table, and software-controlled driver is used with a programmable sewing machine, buttonhole sewing operations begin by placing the stitchable material in the presser foot assembly and engaging its upper and lower components to securely grip the material therebetween. Typically, the presser foot assembly has an opening through which both the sewing needle and cutting head of the material removal device may pass After initializing the positioning of the presser foot assembly and the stitchable material and after selecting the desired sewing pattern, the software activates the driver controllers to propel the cutting head down through the stitchable material to produce an opening therein, after which the cutting head enters the receiver on the table.

When the driver controllers retract the material removal device, the presser foot assembly, maintaining its gripping pressure on the stitchable material, is moved by the controllers as directed by the software over to the sewing area to align the opening in the stitchable material with the hole in the cylinder bed through which the sewing needle passes. A preselected pattern, stored in computer memory and accessed by the software, is then sewn around the opening in the stitchable material by movement of the presser foot assembly as is known in the art to produce a buttonhole or other desirable design.

Although the buttonhole sewing operations sequence has been described as such, it can be appreciated that the sequence may be reversed. More particularly, operations may be initiated by first sewing the desired pattern on the stitchable material and then transferring this portion to the material removal area where the material removal device will then produce the desired opening or hole inside of the pre-stitched pattern. The end product utilizing this alternate sequence is generally the same as otherwise presented herein, except that the hole will not have a stitched border on the interior thereof.

The kit assembly of the present invention provides advantages not found in any known material removal apparatus. For instance, the kit itself allows sewing machines, particularly those which are programmable, to be used for functions other than only sewing buttonholes which increases versatility and thus cost effectiveness. Moreover, no significant structural modification of the sewing machine is typically required, although material removal operations are performed sufficiently close to the sewing area so as to not adversely affect the speed of sewing operations. This is particularly advantageous when the kit assembly of the present invention is used with programmable sewing machines which are often used in industrial, high production applications.

In another embodiment of the present invention, material removal operations are performed with a hollow member. The hollow member facilities the removal of relatively heavy or thick portions of material and also contributes to the carrying away and disposal of the removed material portions. Specifically, pressurized air is supplied to the hollow member for use in carrying away the removed material portions. The supplied air exits the hollow member and the force thereof carries the removed material portions away. Preferably, the removed material portions are received by a container assembly for containing or housing the removed material portions. In a preferred embodiment, the pressurized air is supplied to the hollow member only after the desired portions have been removed from the remaining portions of the material. In one embodiment, this is accomplished by supplying the air to the hollow member at substantially the same time the hollow member is being moved in a direction away from the material.

DETAILED DESCRIPTION

The kit assembly 12 of the present invention will be described with reference to the accompanying drawings which illustrate its pertinent features. Although the kit assembly 12 may be used with standard sewing machines, it is particularly advantageous when used in combination with a programmable sewing machine 16 of the type illustrated in FIG. 1 to provide fully automated buttonhole sewing operations.

Figure 1:
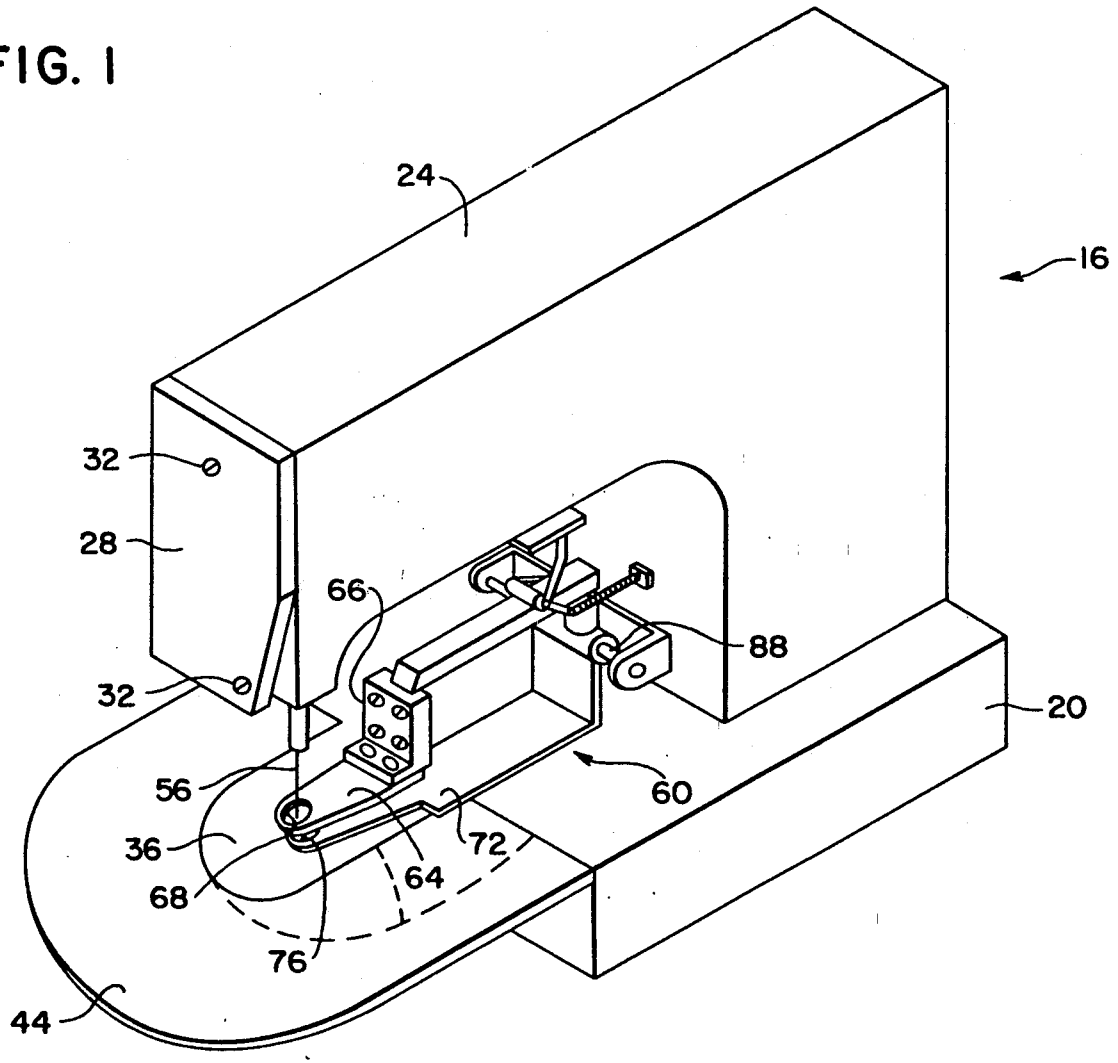
FIG. 1 is a perspective view of a known programmable sewing machine.

With reference primarily to FIG. 1, the programmable sewing machine 16 typically includes a base 20 which functions as a support, a head 24 which contains a portion of the sewing drive assembly 48 (FIG. 3), a detachable head cover 28 for accessing the sewing drive assembly 48 (FIG. 3), a cylinder bed 36 which contains sewing components assembly 52 (FIGS. 3, 5, and 7) which interact with the sewing needle 56 to produce the desired stitch, a detachable support plate 44 which is positioned around the cylinder bed 36 to provide a surface for supporting the material to stitched (FIG. 1), and a presser foot assembly 60 (FIG. 1) which moves the material to be stitched relative to the sewing needle 5 to produce the desired pattern. In order to produce this movement of the presser foot assembly 60, a programmable computer (not shown) governs control motors (not shown) which in turn direct the movement of the presser foot assembly 60 along and relative to the cylinder rod 88 (FIG. 2) and along and relative to another cylinder rod (not shown) which is substantially perpendicular to the rod 88. Consequently, various stitching patterns may be stored in computer memory and accessed by the software to produce a preselected design.

Figure 2:
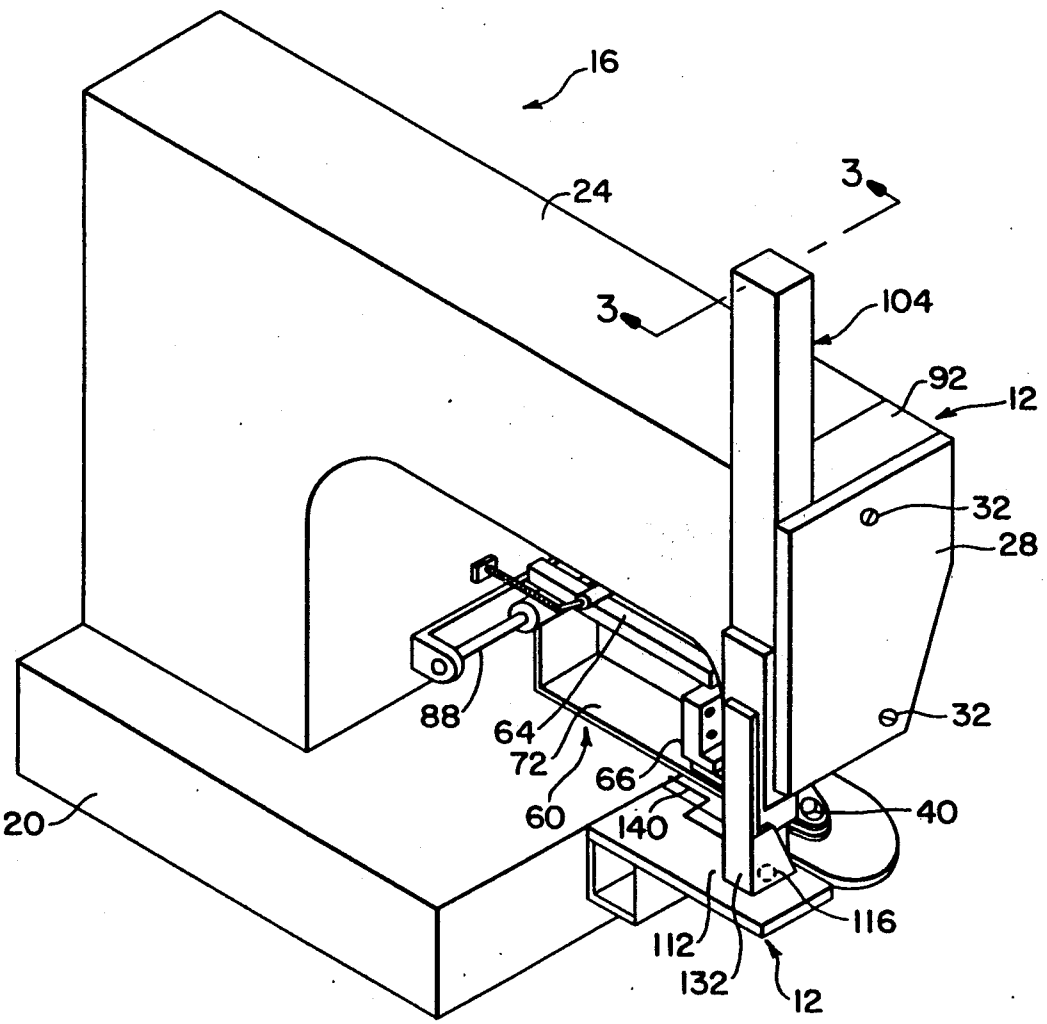
FIG. 2 is a perspective view of the programmable sewing machine incorporating a kit assembly of the present invention.

One embodiment of the kit assembly 12 is illustrated in FIG. 2 as it would be typically attached to a programmable sewing machine 16. The kit assembly 12 generally includes a support assembly 92 which is detachably connected to the end of the head 24 for containing the material removal device 120 (FIGS. 3-4), a driver 104 positioned above the head 24 which is coupled to and drives the material removal device 120, a table 112 which is detachably connected to the programmable sewing machine 16 substantially adjacent to and parallel with the cylinder bed 36, and a guard 132 which is pivotally attached to the support assembly 92 to protect against inadvertent dislodging of the material removal device 120 during sewing operations.

The support assembly 92 is configured to position the material removal device 120 contained therein so as to not interfere with the sewing drive assembly 48 or the sewing components assembly 52, including the sewing needle 56, of the programmable sewing machine 16. In one embodiment illustrated in FIGS. 3-4, a bore 96, positioned within the support assembly 92 and extending substantially vertically therethrough, guides the material removal device 120. This configuration reduces the deflection of the material removal device 120 when used on thicker and/or more resilient stitchable materials 144. In order to provide for a more frictionless engagement between the material removal device 120 and the bore 96, a sleeve bearing 100 of the type well known in the art is positioned therebetween.

The material removal device 120 generally includes a shaft 124, positioned within the bore 96 and coupled with the driver shaft 108 of the driver 104 by methods such as threaded engagement, and a cutting head 128 which removes stitchable material 144 to produce an opening of a desired contour. As can be appreciated, the cutting head 128 may be alternately configured to produce various contours of openings. Furthermore, the cutting head 128 may be a punch, cutting tool or any other suitable device for removing material. Although the shaft 124 and the cutting head 128 of the material removal device 120 may be integrally formed, the cutting head 128 in one embodiment is detachably connected to the shaft 124 by methods such as threaded engagement.

Figure 3:
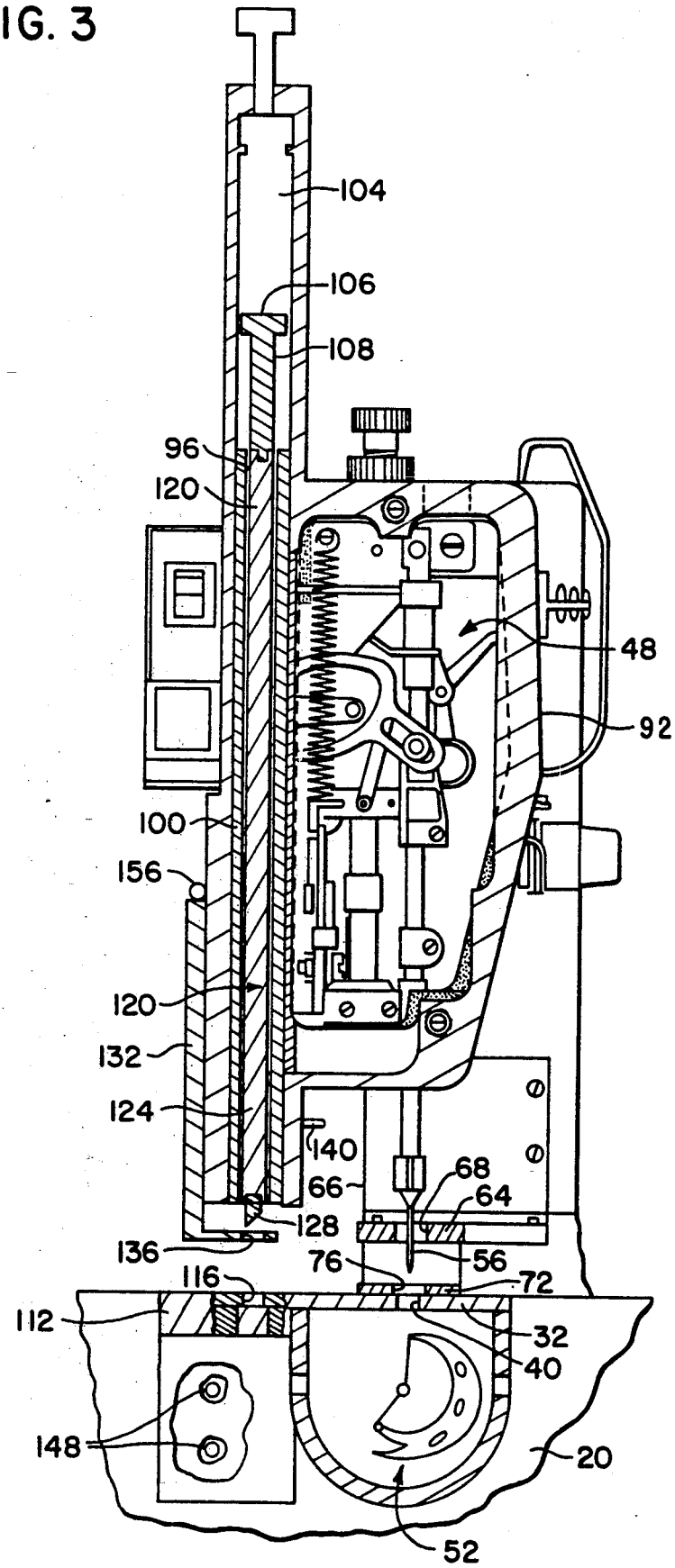
FIG. 3 is a cross-sectional view of the kit assembly of FIG. 2 taken along line 3—3.
Figure 4:
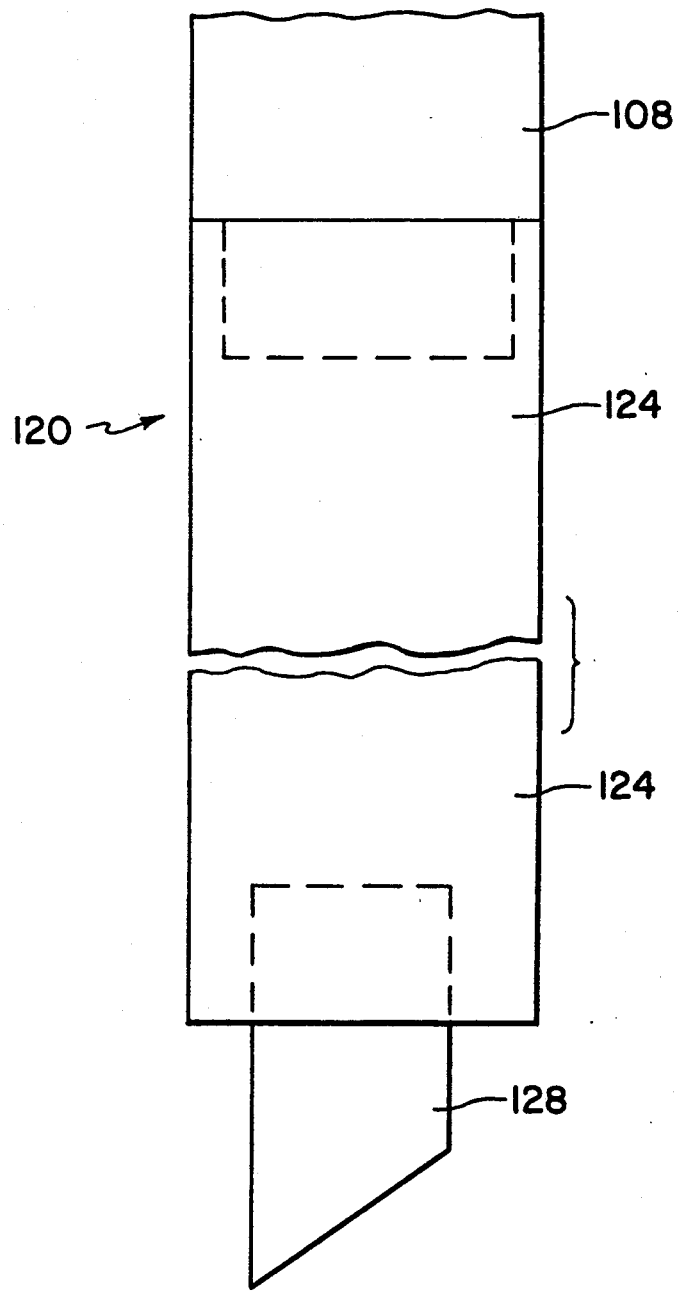
FIG. 4 is an enlarged view of one embodiment of a material removal device and its detachable connections.

The material removal device 120 is coupled with the driver 104 which supplies the necessary driving forces for material removal operations as best illustrated in FIGS. 3-4. Although numerous types of drivers 104 may be used and placed in a variety of positions, in one embodiment the driver is an air cylinder which is positioned above the head 24 and driven by an appropriate source (not shown). This positioning is advantageous in that a larger capacity driver 104, in this case an air cylinder having a driver piston 106 and driver shaft 108, may be used (i.e., more force application capacity) without interfering with the sewing drive assembly 48 or the sewing components assembly 52.

Figure 5:
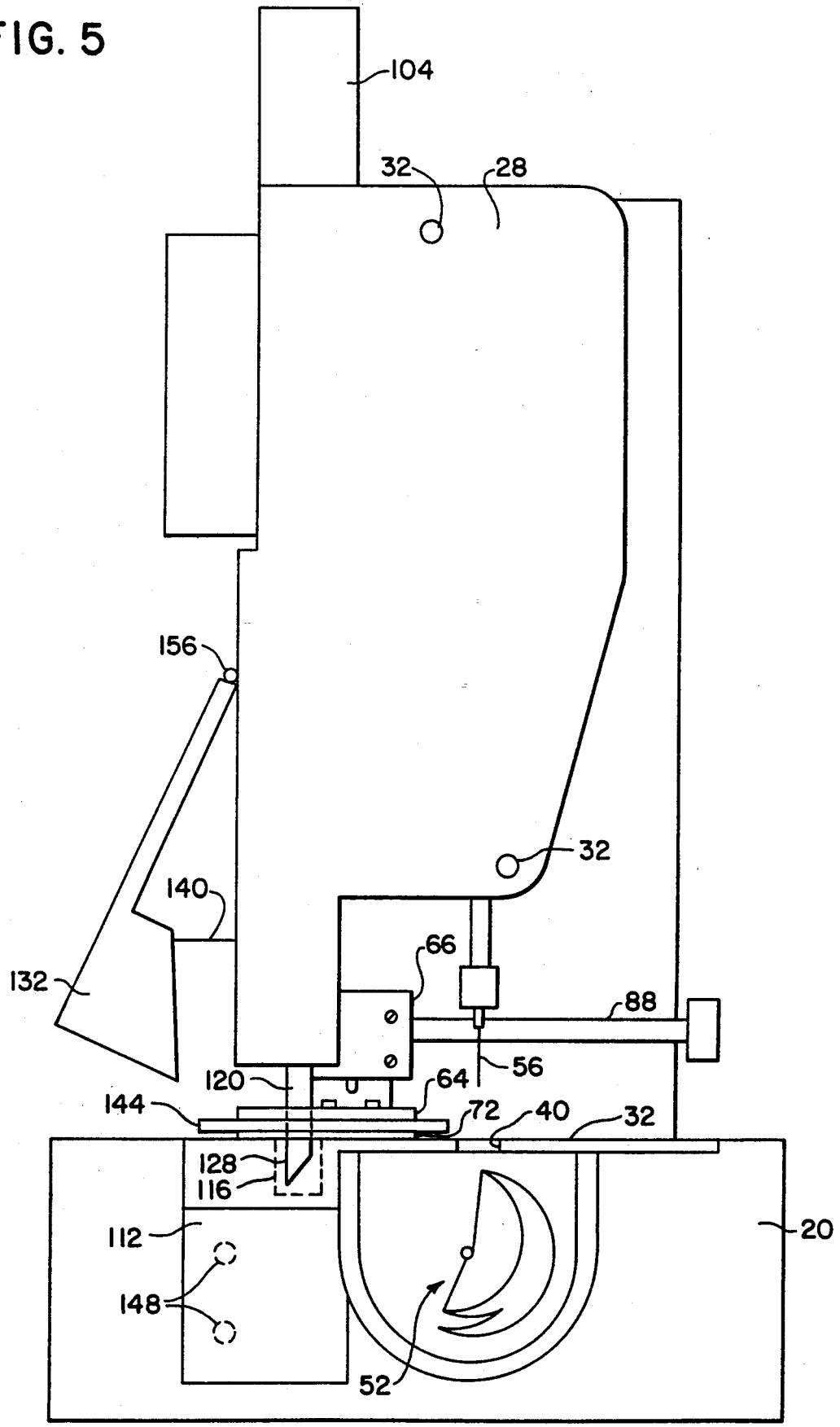
FIG. 5 is a front view of the programmable sewing machine with the kit assembly attached thereto, illustrating the positioning of the presser foot assembly and guard during material removal operations.
Figure 6:
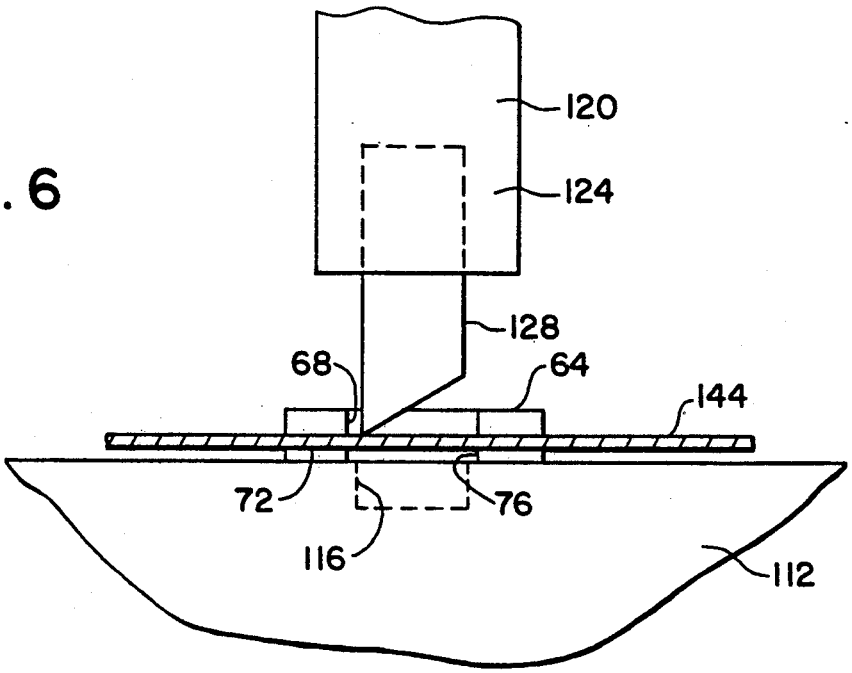
FIG. 6 is an enlarged front view of one embodiment of a material removal device during material removal operations.
Figure 8:
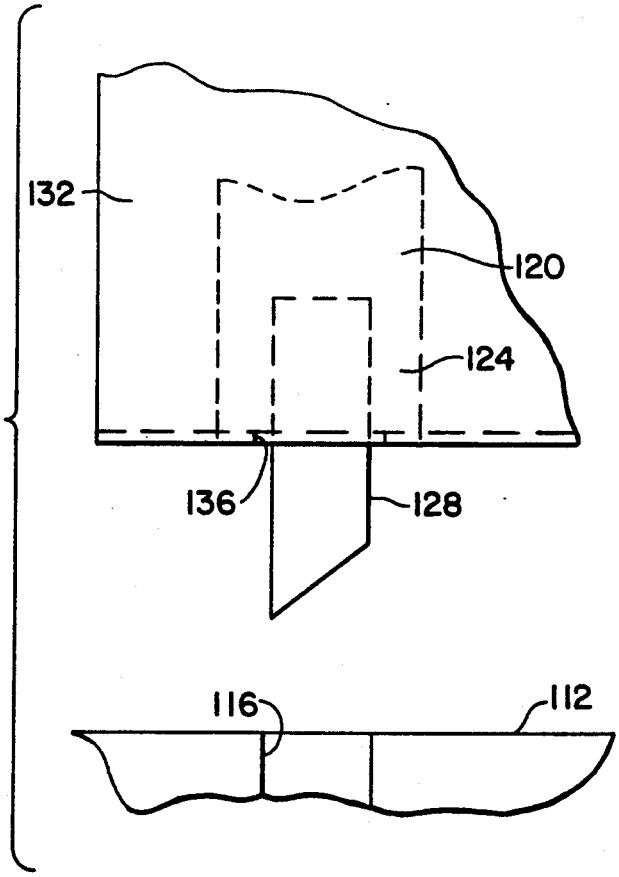
FIG. 8 is an enlarged front view illustrating the restricting of the downward movement of one embodiment of a material removal device by the guard.
Figure 7:
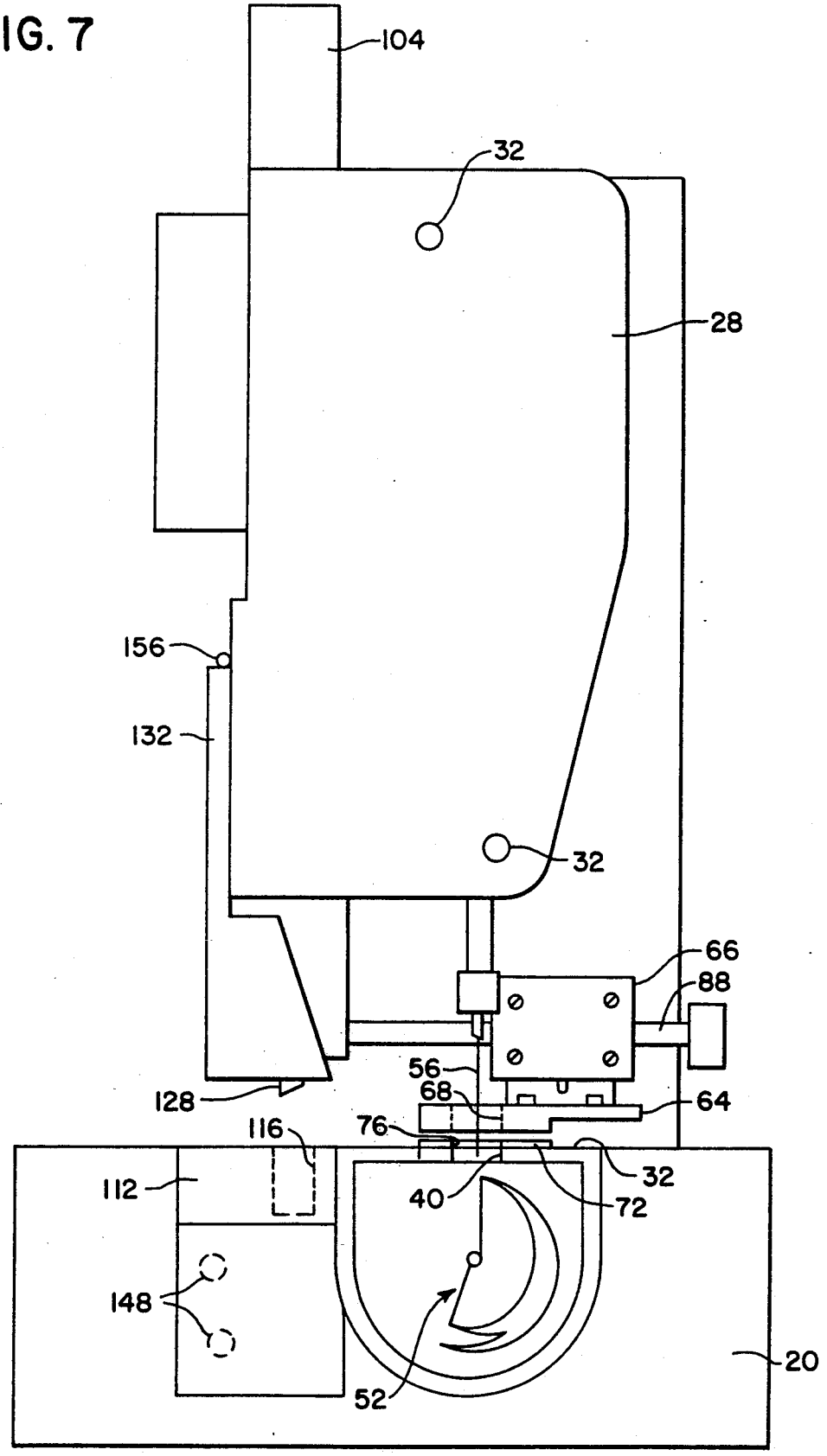
FIG. 7 is a front view of the programmable sewing machine with the kit assembly attached thereto, illustrating the positioning of the presser foot assembly and guard during sewing operations.

For purposes of enhancing operator safety during buttonhole sewing operations, a guard 132 is suitably attached to the support assembly 92, typically by a pivotal connection 156, as illustrated in FIGS. 3, 5, and 7. When the presser foot assembly 60 of the programmable sewing machine 16 is repositioned to the material removal area (FIG. 5) by the software and control motors (not shown), the bracket 66 of the presser foot assembly 60 engages with a guard wire 140 (FIGS. 2–3) attached to the guard 132 which pivots the guard 132 away from the area through which the material removal device 120 travels so that material removal operations may be performed. However, when the presser foot assembly 60 moves to the position illustrated in FIG. 7 to perform sewing operations, the guard 132 pivots to a position around and below which the material removal device 120 normally travels to restrict its downward movement in the event it is inadvertently deployed. In this regard, the cutting head 128 may pass through a guard hole 136 on the bottom of the guard 132 so that it is not damaged, as best illustrated in FIG. 8. However, the shaft 124 of the material removal device 120 is of a larger diameter than the guard hole 136 and thus inhibits further downward movement of the material removal device 120.

In order to provide a suitable surface for the material removal device 120 to engage with during material removal operations, the support plate 44 (FIG. 1) is replaced with a table 112 (FIG. 2) which is detachably connected to the programmable sewing machine 16 in a position which is substantially adjacent to and parallel with the cylinder bed 36. Positioned within the table 112, as best illustrated in FIGS. 3, 5, and 6–8, is a recessed receiver 116 in which the cutting head 128 of the material removal device 120 enters after having fully passed through the stitchable material 144. In order to enhance cutting of the stitchable material 144, the upper portion of the receiver 116 may be contoured to provide a cutting edge.

An advantage of the structural configuration of the kit assembly 12 presented herein is that it is positioned a sufficient distance from the sewing drive assembly 48 and the sewing components assembly 52, including the sewing needle 56, so as to not interfere with their normal operations. Nonetheless, the kit assembly 12 may be positioned sufficiently close to the sewing area defined by the cylinder bed 36, more particularly the sewing needle 56 and the cylinder bed hole 40, so as to not adversely affect the overall speed of buttonhole sewing operations. In this regard, preferably the distance between the centers of the recessed receiver 116 and the cylinder bed hole 40 will be about five (5) inches or less.

Installation of the kit assembly of the present invention typically requires little if any modification of the programmable sewing machine 16. When used with a programmable sewing machine of the type illustrated in FIG. 1, the head cover 28 is detached by removing the head cover screws 32 and the support assembly 92, which preferably is configured to substantially follow the contour of the end of the head 24, is mounted to the head 24. The head cover 28 may then positioned on the end of the support assembly 92 and the head cover screws 32, or appropriate substitutes, may be positioned through the holes in the head cover 28, the support assembly 92, and programmable sewing machine 16. In order to complete the installation, the support plate 44 is removed and the table 112 is positioned substantially adjacent to and parallel with the cylinder bed 36 and is attached to the programmable sewing machine 16 in an appropriate manner by, for instance, two fasteners 148 (FIG. 3). Although material removal operations may be manually controlled, preferably the kit assembly 12 is integrated with the software of the programmable sewing machine 16 such that fully automated operations will be provided.

When the kit assembly 12 has been properly integrated with the controlling software for the programmable sewing machine 16 and buttonhole operations are to be initiated, the stitchable material is placed in the presser foot assembly 60 of the programmable sewing machine 16 between the upper presser foot 64 and the lower presser foot 72. Thereafter, the presser foot assembly 60 is engaged as is known in the art to firmly secure the stitchable material 144. Then the presser foot assembly 60, together with the stitchable material 144, is moved to the desired position for material removal operations as generally illustrated in FIG. 5. As the presser foot assembly 60 is repositioned over the table 112, the bracket 66 engages the guard wire 140 attached to the punch guard 132 such that it pivots away from the support assembly 92 into the position illustrated in FIG. 5.

Once the desired sewing pattern has been selected, the software sends a signal to the driver 104 to activate the material removal device 120. Consequently, the material removal device 120 is driven down through the upper and lower presser foot holes 68, 76, respectively, and the stitchable material 144 until the cutting head 128 enters the receiver 116 in the table 112. After the desired portion of the stitchable material 144 has been removed, the software directs the controllers (not shown) to retract the driver shaft 108 of the driver 104 and thus the material removal device 120.

After the material removal operations are completed, the presser foot assembly 60, as directed by the software and through use of the control motors (not shown), is moved laterally toward the cylinder bed 36 along the cylinder rod 88 to align the opening in the stitchable material 144 with the sewing needle 56. During this movement of the presser foot assembly 60, the guard 132 moves into the position illustrated in FIG. 7 since the bracket 66 of the presser foot assembly 60 no longer exerts a force on the guard wire 140. When the stitchable material 144 is properly positioned relative to the sewing needle 56, the software directs the sewing drive assembly 48 to begin sewing operations through the sewing components assembly 52, including the sewing needle 56, as is well known in the art. Consequently, a buttonhole pattern is sewn around the opening in the desired manner.

Once sewing operations are completed, the software directs the controllers (not shown) to move the presser foot assembly 60, together with the stitchable material 144, in a lateral direction along the cylinder rod 88 from the position illustrated in FIG. 7 back to the initial position generally illustrated in FIG. 5. When this movement is initiated, the sewing needle 56 is in an upward position as illustrated in FIG. 5 so as to not catch on the upper presser foot 64. Moreover, as the presser foot assembly 60 is repositioned over the table 112, the bracket such that it pivots away from the support assembly 92 into the position illustrated in FIG. 5 to allow material removal operations to be performed. Thereafter, the cycle of material removal and sewing operations may be repeated in the above-described manner.

Although the buttonhole sewing sequence has been described as such, it can be appreciated that the sequence may be reversed. In this regard, the sewing operations would first produce the desired stitching pattern on the stitchable material 144. Thereafter, material removal operations would be performed to remove portions of the stitchable material 144 inside of the area defined by the stitching pattern. Although the same general end product is obtained by both sequences, performing material removal operations after sewing operations results in a hole or opening not having a stitched border therearound, thereby exposing some fibers of the stitchable material 144.

As can be appreciated by those skilled in the art, after buttonhole sewing operations are completed, the punch kit assembly 12 of the present invention may be disabled or entirely removed such that the programmable sewing machine 16 may be used for alternate functions. This is desirable since most programmable sewing machines are used for industrial applications and thus are quite expensive. Moreover, essentially no structural modification is required of the programmable sewing machine 16 to use the kit assembly 12 so that performance of the programmable sewing machine 16 is not adversely affected. Furthermore, material removal operations take place sufficiently close to the sewing area such that the overall speed of sewing operations is not adversely affected.

Figure 10:
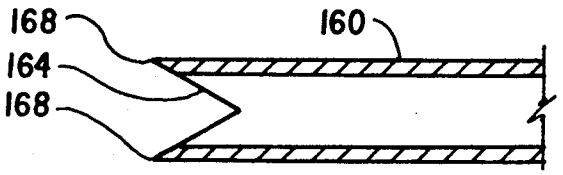
FIG. 10 is a cross-sectional view of the material removal device of FIG. 9 taken along line 10—10.
Figure 9:
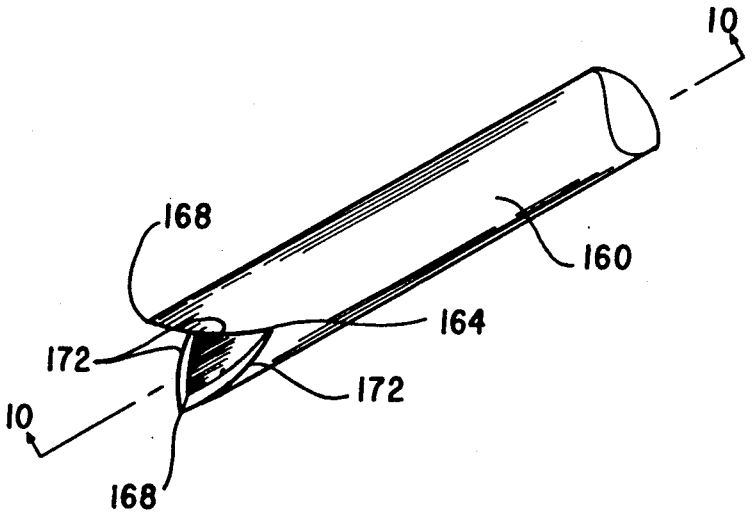
FIG. 9 is a perspective view of one embodiment of a hollow material removal device.

Another embodiment of the present invention is directed toward efficiently removing material portions of a stitchable material and then carrying away and preferably disposing of such removed portions. As can be appreciated, when removing material portions of heavy-duty stitchable materials (e.g., multiple plies, thicker materials, resilient materials), an increased amount of force may be required to drive the material removal device 120 discussed above through such materials, particularly if the portion of the cutting head 128 of the material removal device 120 which interacts with the stitchable material is a substantially continuous planar surface (e.g., a blunt-nosed configuration). Consequently, the material removal device 160 of FIGS. 9–10 utilizes a hollow configuration which reduces the area of contact between the stitchable material and the material removal device 160 to effectively an edge, thereby providing for an enhanced "cutting" action and more efficient penetration.

The material removal device 160 utilizes a hollow tubular configuration and V-shaped portions 164 are positioned on opposite sides of the device 160 such that there are two points 168 which first engage the stitchable material for a more effective initial separation thereof. Moreover, the V-shaped portions 164 define four cutting edges 172 (only three shown) which taper outwardly from the points 168 to further enhance the separation of the stitchable material as the material removal device 160 is driven downwardly through the stitchable material. Although the material removal device 160 may be formed from a variety of materials, preferably the device 160 is metal which improves its durability and allows for the provision of sharp cutting edges 172. Moreover, as can be appreciated the diameter and/or end configuration of the hollow material removal device 160 may be varied depending upon criteria such as the given applications requirements. For instance, the material removal device 160 is substantially circular with an outside diameter ranging from about ⅛ inch to about ¼ inch.

Figure 11:
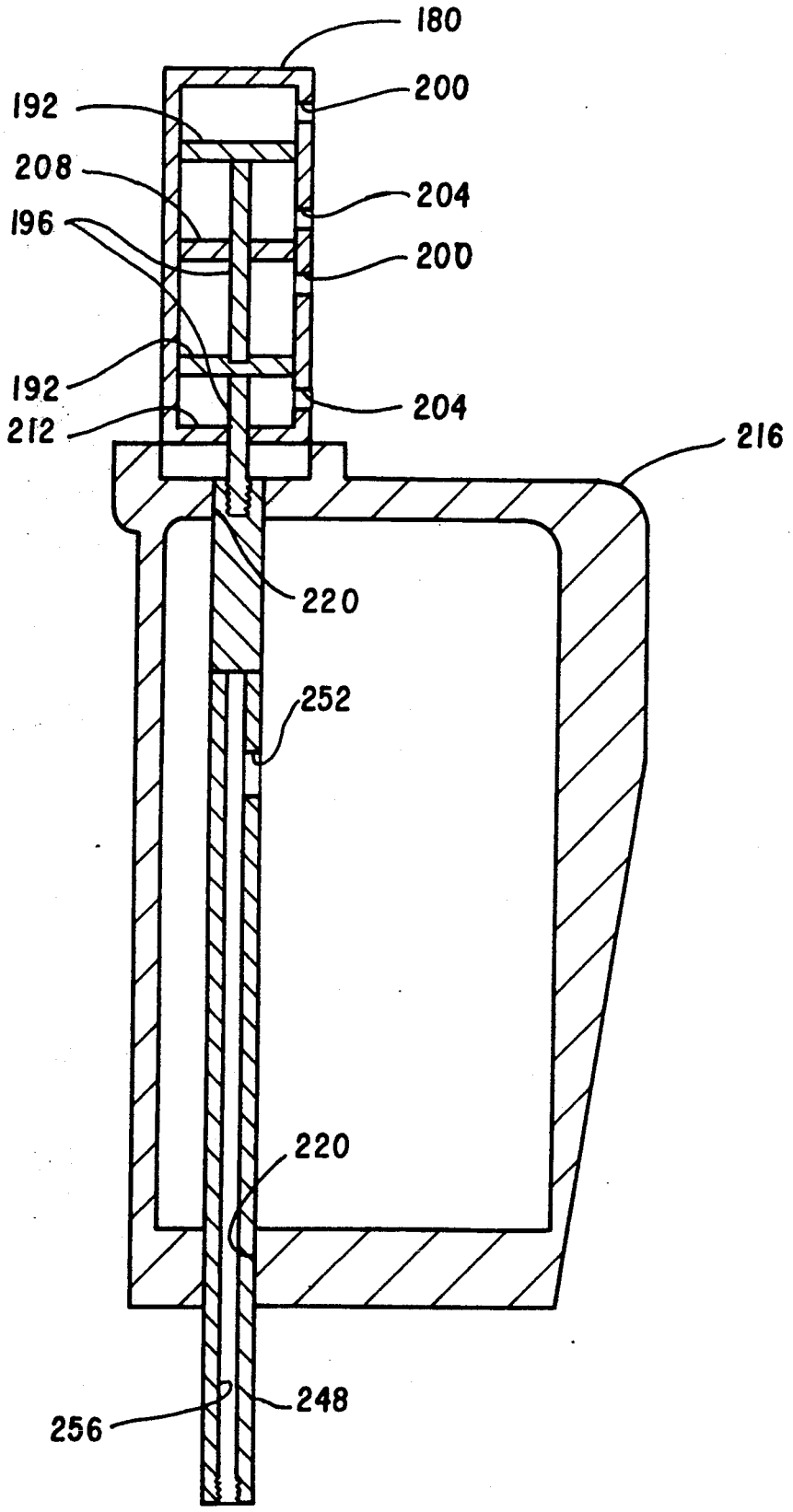
FIG. 11 is a cross-sectional view of one embodiment of a drive assembly for material removal operations which utilizes a system for carrying away the removed portions.

The material removal device 160 is driven downwardly into engagement with the stitchable material to remove material portions thereof. Although a number of drive mechanisms for performing this function would be appropriate, FIG. 11 illustrates a drive assembly 180 which is particularly suitable based upon the portion disposal system 244 which is preferably used with the material removal device 160 as will be discussed below.

The drive assembly 180 is appropriately mounted on a support assembly 216. The support assembly 216 preferably approximates the contour of an end portion of the head 24 of the programmable sewing machine 16 (FIG. 1) such that the assembly 216 may be attached thereto in a manner similar to support assembly 92 discussed above. The drive assembly 180 utilizes two chambers 188 in a "series" configuration (i.e., stacked), the chambers 188 being separated by a partition 208. Each chamber 188 has a piston 192 slidably positioned therein with a piston shaft 196 being attached to each of the pistons 192 to transfer the motion of such pistons 192 to a desired object. In this regard, the uppermost piston shaft 196 extends through the partition 208 and engages the lowermost piston 192 in an appropriate manner. The piston shaft 196 of the lowermost piston 192 extends through the bottom 212 of the drive assembly 180 to engage the connecting shaft 248 which is used to transfer the motion of the pistons 192 to the material removal device 160. Consequently, the pistons 192 and thus the piston shafts 196 are capable of simultaneous movement to govern movement of the material removal device 160.

The drive assembly 180 is a dual action configuration in that each chamber 188 has an upper and lower port 200, 204. Consequently, conduits (not shown) may be connected to the upper and lower ports 200, 204 to supply a medium to alternately act against the opposite sides of the pistons 192 at the appropriate times and thus achieve the desired downward and upward motion for the material removal device 160. Although various mediums may be employed, preferably a pneumatic system (not shown) is utilized for driving the pistons 192 through this downward/upward cyclic motion.

The simultaneous movement of the pistons 192 is transferred to the connecting shaft 248 which has the material removal device 160 attached at its opposite end. The lowermost piston shaft 196 may engage the upper end of the shaft 248 by various appropriate manners, such as threaded engagement. The material removal device 160 may also be similarly attached to the lower end of the shaft 248. In order to stabilize the connecting shaft 248 and limit the deflection thereof when engaged in material removal operations, the shaft 248 and/or the lowermost piston shaft 192 pass through a bore 220 in the upper and lower portions of the support assembly 216. Although not shown, a sleeve bearing may again be utilized in the bores 220 to reduce the frictional engagement of the shaft 248 and/or piston shaft 196 with the support assembly 216.

Based upon the hollow configuration of the material removal device 160 and the downward direction in which the device 160 moves when removing portions of stitchable material, there may be a tendency for the removed portions to move up within the hollow interior of the device 160. After an extended period of operation, the potential for a plurality of such removed portions filling or becoming jammed within the entire interior portion of the material removal device 160 increases, which could adversely affect material removal operations. In order to reduce this potential, the material removal device 160 is preferably used in combination with the portion disposal system 244 illustrated in FIGS. 11 and 12.

The portion disposal system 244 carries away the removed portions of stitchable material. A portion of the disposal system 244 is incorporated within the drive assembly 180 discussed above in that the connecting shaft 248, which is again used to transfer the motion of the pistons 192 to the material removal device 160, has an inner cavity 256 which extends along a portion of the length of the shaft 248 and which is in communication with the hollow interior of the material removal device 160. A port 252 extends through a wall of the shaft 248 in an appropriate location to interact with this cavity 256. Consequently, an appropriate conduit (not shown) may be positioned within the port 252 such that an appropriate medium may be forced through the inner cavity 256 to discharge the removed material portions from the end of the material removal device 160 at the appropriate time. As can be appreciated, such removed portions could also be withdrawn from the interior of the hollow material removal device 160 by a suction-type action.

Figure 12:
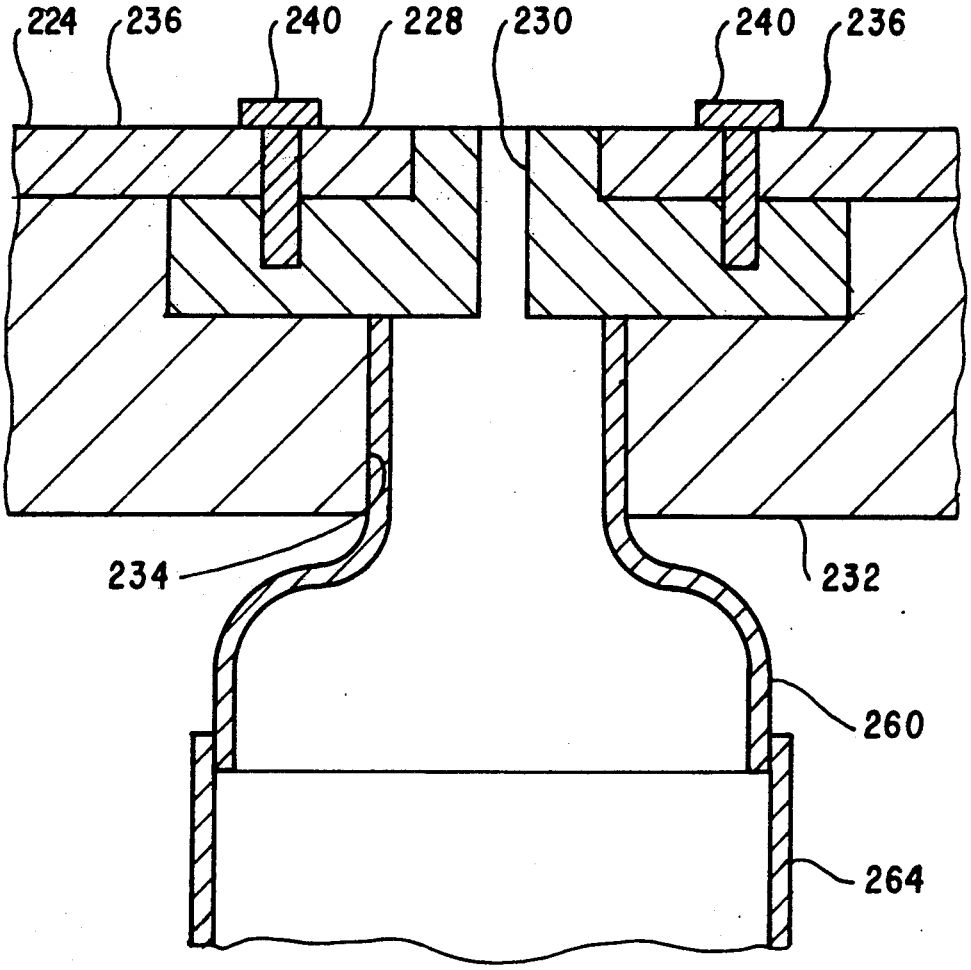
FIG. 12 is one embodiment of a table for interacting with the material removal device and which incorporates a part of a portion disposal system.

In order to allow for the collection of the removed portions of stitchable material the above-described table 112 and receiver 116 are modified. FIG. 12 illustrates the pertinent portions of the table 224 which accommodates for use of the portion disposal system 244, the remainder of the table 224 being substantially similar to the table 112 described above for similar attachment to the programmable sewing machine 16 (e.g., such that the table 224 is substantially parallel with and adjacent to the cylinder bed 36). The table 224 includes an insert 228 with a bore 230 therethrough such that the shaft 248 and the attached material removal device 160 may travel within the bore 230 during material removal operations. The insert 228 is seated within a base 232 and is secured therein by positioning plates 236 over portions of the insert 228 and by engaging the plates 236, insert 228, and base 232 with screws 240.

A bore 234 within the base 232 is substantially aligned with the bore 230 in the insert 228. A bell-shaped adapter 260 is positioned and secured within the bore 234, such as by threaded engagement, in order to interconnect the bore 234 and a conduit 264 attached to the adapter 260. The removed portions of stitchable material may therefore ultimately flow through the conduit 264 and be appropriately deposited. In this regard, the opposite end of the conduit 264 is preferably connected to an appropriate receptacle (not shown) which will contain the removed portions of stitchable material. Based upon the preferred medium used by the portion disposal system 244, namely forced air, this receptacle is preferably formed from a material which will allow the medium to pass therethrough but which will retain the portions of stitchable materials, such as a cotton receptacle.

In summarizing the operation of the material removal operations when the material removal device 160 is used in combination with the portion disposal system 244, the pistons 192 of the drive assembly 180 will be in their uppermost positions within the respective chambers 188 prior to initiation of the removal operations. When the stitchable material has been properly positioned for removal operations in the above-described manner, the medium, again preferably air, is provided through the upper ports 200 of the chambers 188 to drive the pistons 192 in a downward direction. Consequently, the shaft 248 and material removal device 160 are also driven in a downward direction such that the material removal device 160 penetrates and passes through the stitchable material to remove material portions thereof. As a result, the material removal device 160 enters the bore 230 of the insert 228.

Figure 13:
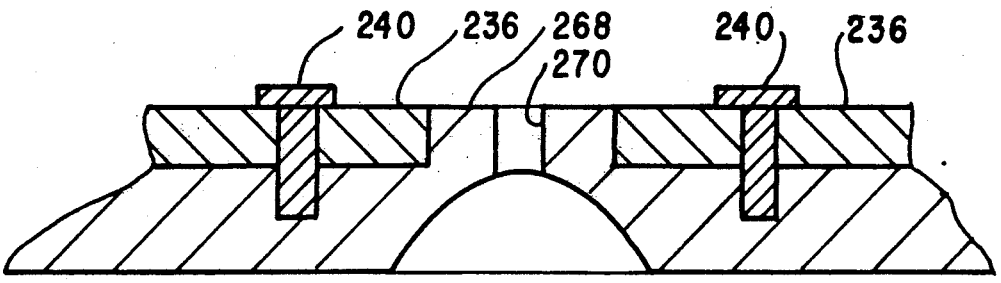
FIG. 13 is one embodiment of a table for interacting with a light duty material removal device.

As can be appreciated, when heavy duty stitchable materials are being subjected to the above-described material removal operations, particularly when relatively thick materials are being used, it may be necessary for the length of the bore 230 to be sufficiently long since there may be a tendency for these thicker materials to stretch during material removal operations. In this regard, a length of approximately ¼ inch for the bore 230 will accommodate for this stretching in most applications. However, when relatively light materials are subjected to material removal operations, the insert 268 of FIG. 13 may be utilized in which the length of the corresponding bore 270 therein is approximately 1/16 of an inch and is formed by doming out the lower portion of the insert 268. This insert 268 may be used in the base 232 discussed above (i.e., such that the portion disposal system 244 may be used therewith) or the insert may be used without the portion disposal system 244, such as in the above-described embodiment of the kit assembly 12 for removing material portions of stitchable material.

Once a material portion of the stitchable material has been removed in accordance with the above process, the portion disposal system 244 may be activated to carry away the removed portion. In this regard, a medium, again preferably air, is forced through the port 252 in the shaft 248 such that the air will pass through the inner cavity 256 and the material removal device 160 to propel the removed portion from the end of the device 160. Thereafter, the removed portion passes through the adapter 260 and conduit 264 to an appropriate receptacle (not shown) as discussed above.

A number of alternatives may be utilized for the sources of the mediums for moving the pistons 192 and for use in the portion disposal system 244. In a preferred embodiment, a pneumatic supply system (not shown) is utilized and separate lines (not shown) are used to supply air to the chambers 188 and the portion disposal system 244. This allows the pressure of air supplied to the chambers 188 and the disposal system 244 to be controlled independently. However, the air which is used to drive the pistons 192 in the downward direction, which is evacuated from the chambers 188 when air is applied to the lower ports 204 to reinitialize the positioning of the pistons 192 and thus the material removal device 160 after a single removal operation is completed, may be used to provide the air used by the portion disposal system 244. In this regard, a conduit (not shown) would interconnect one or both of the upper ports 200 with the port 252 in shaft 248 of the disposal system 244.

The above-described drive assembly 180 and portion disposal system 244 may also of course utilize well known electronic or other sensing techniques such that material removal operations and the disposal of the removed portions can be performed in an automated manner, together with the sewing operations, so as to take full advantage of the capabilities of the programmable sewing machine 16. Consequently, the portion disposal system 244 can be activated via these sensing capabilities (i.e., air supplied through the inner cavity 256 of the shaft 24 and through the interior of the material removal device 160) simultaneously with the contacting of the stitchable material by the material removal device 160 or soon thereafter. Preferably, however, the portion disposal system 244 is not activated until the material removal device 160 has completely passed through the stitchable material. This not only may assist in the retraction of the pistons 192, but it reduces the potential for the forced air having an adverse affect on the material removal operations. For instance, in the event that air is provided to the disposal system 244 prior to the material removal device 160 contacting the stitchable material, not only does this provide a braking action to the downward motion of the material cutting device 160 (i.e., by working against the action of the device 160), but it may also undesirably disturb and/or disfigure the stitchable material.

Although the portion disposal system 244 has been described with regard to using a table 224 and support assembly 216 which are detachably connectable to a programmable sewing machine 16 to in effect provide a kit for us with existing machines 16 which again does not require significant modification thereof, the portion disposal system 244 may of course be used with other material removal operation apparatus. For instance, the described portion disposal system 244 may be utilized on a programmable sewing machine 16 in which the casting of the machine 16 is formed to accommodate the permanent incorporation of a material removal system (i.e., a machine 16 in which the cylinder bed 36 effectively incorporates the table 216 and in which the head 24 permanently incorporates the drive assembly 180 for the material removal device 160).

Although the portion disposal system 244 has been described with reference to the use of air for carrying away the removed portion of stitchable material, those skilled in the art will appreciate that a number of alternatives exist for displacing the removed portion of stitchable material from an end of the material removal device 160. For instance, other pressurized fluids may be utilized. Moreover, the removed portion may be mechanically displaced from the material removal device 160. More particularly, a rod may be propelled through the interior portion of the material removal device 160 by an appropriate drive assembly.

The foregoing description of the invention has been presented for purposes of illustration and description. Further, the description is not intended to limit the invention to the form disclosed herein. Consequently, variations and modifications commensurate with the above teachings, in the skill or knowledge of the art, are within the scope of the present invention. The embodiments described hereinabove are further intended to explain best modes known of practicing the invention and to enable others skilled in the art to utilize the invention in such, or other, embodiments and with the various modifications required by their particular applications or uses of the invention. It is intended that the appended claims be construed to include alternative embodiments to the extent permitted by the prior art.

What is claimed is:

1. A device for removing and carrying away portions of material and used in conjunction with a sewing machine, comprising:

hollow means movable in two directions for moving through material to remove portions from the material;

first means for causing movement of said hollow means, said first means comprising:

cylinder/piston means in which a piston moves relative to a cylinder using pressurized fluid;

first pressurized fluid inlet means provided adjacent to a first side of said piston for receiving pressurized fluid that is used in moving said hollow means in a first direction; and second pressurized fluid inlet means provided adjacent to a second side of said piston for use in causing said piston to move in a second direction; and second means including force means movable relative to said hollow means for use in carrying away portions removed from the material, said force means being caused to move after said hollow means engages the material and comprising pressurized fluid; and third pressurized fluid inlet means provided adjacent to said hollow means for supplying said pressurized fluid of said force means to carry away portions removed from the material, said pressurized fluid of said force means exiting said hollow means.

2. A device, as claimed in claim 1, wherein:

said piston is substantially solid and wherein substantially no fluid passes through said piston.

3. A device, as claimed in claim 1, wherein:

said third inlet means is connected to at least one of said first inlet means and said second inlet means.

* * * * *

UNITED STATES PATENT AND TRADEMARK OFFICE

CERTIFICATE OF CORRECTION

PATENT NO. : 5,193,471

DATED : March 16, 1993

INVENTOR(S) : BADILLO et al.,

It is certified that error appears in the above-identified patent and that said Letters Patent is hereby corrected as shown below:

Column 3, line 43, please delete the word "an" and insert therefor --and--

Column 6, line 3, please delete the number "5" and insert therfor --56--

Signed and Sealed this

Thirty-first Day of May, 1994

Bruce Lehman

*Attest:*

BRUCE LEHMAN

*Attesting Officer*

*Commissioner of Patents and Trademarks*